United States Patent [19]

Vandendorpe

[11] Patent Number: 4,913,631

[45] Date of Patent: Apr. 3, 1990

[54] TURBINE-DRIVEN ROTARY PUMP

[75] Inventor: Guido Vandendorpe, Brussels, Belgium

[73] Assignee: S. A. Dragages Decloedt and Fils, Brussels, Belgium

[21] Appl. No.: 296,227

[22] Filed: Jan. 12, 1989

[30] Foreign Application Priority Data

Jan. 18, 1988 [BE] Belgium ..... 8800060

[51] Int. Cl.[4] ..... F04B 35/00

[52] U.S. Cl. ..... 417/355; 417/91

[58] Field of Search ..... 417/91, 408, 355, 423.13; 60/220, 221; 415/143, 169.1

[56] References Cited

U.S. PATENT DOCUMENTS

| | | | |
|---|---|---|---|
| 2,113,213 | 4/1938 | Leonard | 417/408 |
| 2,164,975 | 7/1939 | Whitcomb | 417/408 |
| 2,906,447 | 9/1959 | Seed | 417/408 |
| 3,004,494 | 10/1961 | Corbett | 417/355 |

FOREIGN PATENT DOCUMENTS

| | | |
|---|---|---|
| 309856 | 12/1918 | Fed. Rep. of Germany . |
| 3008334 | 2/1982 | Fed. Rep. of Germany . |
| 2105610 | 4/1972 | France . |
| 465413 | 12/1968 | Switzerland . |
| 870262 | 6/1961 | United Kingdom . |

*Primary Examiner*—Donald E. Stout
*Assistant Examiner*—Robert N. Blackmon
*Attorney, Agent, or Firm*—Ladas & Parry

[57] ABSTRACT

The invention relates to a motor-driven pump intended for the pumping of liquids and driven by a pressurized motive fluid. The motor-driven pump (1) has a rotary sleeve (12) mounted in line between two stationary connections (8, 10). Mounted on the periphery of this sleeve (12) are the blades of a turbine which surrounds the sleeve (12). Rotary pumping members (24) are fastened inside the sleeve (12). The motor-driven pump (1) of the invention is intended more particularly for use as a submerged pump, especially as a pump for dredging at great depth.

20 Claims, 4 Drawing Sheets

TURBINE-DRIVEN ROTARY PUMP

FIELD OF THE INVENTION

The invention relates to a turbine-driven pump actuated by a pressurized fluid for the pumping of liquids or of liquids laden with solids.

BACKGROUND OF THE INVENTION

Turbine-driven rotary pumps are already known. These motor-driven pumps are distinguished not only by the types of pumps used and by the model of the turbine, but also by the mutual arrangement of the turbine and pump and, ipso facto, by the mechanical transmission of the movement between these two component parts of the motor-driven pump.

In particular, there are known motor-driven pumps, in which the turbine and the pump are arranged in line, that is to say the axis of the pump and the axis of the turbine are located in the extension of one another. In such motor-driven pumps, at least one of the two (inlet and outlet) connections of the pump is arranged perpendicularly or obliquely relative to the axis of the pump, whereas the second connection is arranged either perpendicularly or obliquely relative to the axis of the pump or in line with the axis of the pump (on that side of the pump located opposite the turbine).

The application DE-A-No. 3,008,334 describes a tangential turbine driving a pump, the rotary body of which is formed by the hollow shaft of the turbine, the machine described in the application DE-A-No. 3,008,334 operating by steam; this steam does not advance in the turbine along the same axis as the pumped fluid.

The document CH No. 465,413 describes a single-axis pump intended for a stationary installation in a nuclear power station. The pump is actuated by a peripheral turbine. However, the rotor of the pump is supported by bearings which encroach on the available cross-section, without any possible mixing between the motive fluid and the pumped fluid.

U.S. Pat. No. 2,113,213 describes cylindrical pumps formed from a small rotary pump and from a concentric turbine. These pumps are intended for operating in wells for extracting water or crude oil from them. These pumps connected in series are placed in a containment and buried under the body of liquid to be pumped. Each pump is equipped with vents at its base. When a pressurized fluid is injected into the containment, it rises via the vents, setting the turbine in rotation and thus actuating the pump. The motive fluid subsequently mixes completely with the liquid pumped in order to rise to the surface.

For some uses, the motor-driven pumps known at the present time all have serious disadvantages; this is especially true of submerged motor-driven pumps used for dredging operations.

In suction dredges, the boom is equipped with a suction pump intended for conveying the dredged materials (mud and/or sand) into the wells of the dredger or into delivery pipes.

Suction can be carried out by means of a motor-driven pump mounted on board the dredger. However, such a system is suitable only for relatively small dredging depths.

For dredging at greater depth, it is usually necessary to employ a submerged motor-driven pump mounted as low as possible on the suction pipe.

Such a submerged motor-driven pump thus works under pressure, and therefore its suction performances are improved. Nevertheless, employing motor-driven pumps known at the present time for such uses presents very serious technical problems attributable particularly to the high weight and large bulk of these motor-driven pumps and of the bent pipelines connected to them. Thus, a submerged motor-driven dredging pump which can be connected to pipes of a diameter of 650 mm represents a weight of the order of 25 tons, a length of 6 m and a lateral bulk of 3 m (including the bent pipes and the frame which is necessary for absorbing the stresses generated during manoeuvring and functioning). The manoeuvring of a dredging head equipped with such a motor-driven pump of known type makes it necessary to use heavy and costly handling appliances.

Another problem arises because of the (mechanically speaking) difficult environment in which these motor-driven pumps have to be used, namely generally aggressive water, such as seawater, laden with salt and with particles of varied granulometry.

To protect the delicate parts of these motor-driven pumps, sealing devices of extremely high performance are generally employed, particularly to protect the rolling bearings and elements of the turbine, thereby proportionately increasing the weight and bulk and also presenting problems of maintenance and heat dissipation.

The motor-driven pump according to the invention, which will be described below, can be used particularly as a submerged motor-driven pump and is especially highly advantageous as a submerged motor-driven pump for dredging and working ocean sediments at great depth. However, the use of the motor-driven pump according to the invention is in no way limited to these particular examples, and it can also advantageously be used as a non-submerged motor-driven pump for the pumping of various liquids or liquids laden with solids (for example, suspensions of ores and/or coal in water).

SUMMARY OF THE INVENTION

The object of the present invention is to provide a motor-driven pump, in which the inlet and outlet ports of the pump are arranged in line with one another, thus making it possible to reduce the pressure losses attributable to the change of direction of the liquid, the problems of obstruction and the wear attributable to the impact and friction of the particles with which the liquid is laden.

Another object of the invention is to provide such a motor-driven pump of reduced bulk and of robust construction, so as effectively to withstand the tensile, bending and torsional forces to which it can be subjected during its use, and so as to be very easy to handle.

Yet another object of the invention is to provide such a motor-driven pump which can be submerged and function with a high degree of safety for personnel and a low risk of breakdown or damage.

A further object of the invention is to provide such a motor-driven pump which can advantageously be used for the pumping of liquids heavily laden with solids and which is thus suitable as a motor-driven pump for dredging or working sediments on the seabed.

The object of the invention is, moreover, to provide such a motor-driven pump in which energy losses are appreciably reduced.

Finally, another object of the invention is a motor-driven pump which is of low maintenance cost and the members of which can easily be replaced.

The subject of the invention is a turbine-driven rotary pump driven by a pressurized fluid intended for the pumping of liquids and of liquids laden with solid particles; this motor-driven pump comprises the following members:

a stationary pump body possessing a connection forming a cylindrical suction port and a connection forming a cylindrical delivery port; these two connections of the same inside diameter are arranged in line with one another, a cylindrical sleeve of an inside diameter substantially equal to that of the two above-mentioned connections and mounted in line between these two connections with a small clearance relative to these, this sleeve being capable of rotating about its axis, and rotary pumping members being mounted inside the sleeve and being fixed to the latter, a drive turbine actuated by a pressurized fluid and mounted in a ring round the sleeve, the rotor supporting the blades of the turbine being mounted outside the sleeve and being fixed to the latter, the stationary body of the turbine being fixed to the stationary pump body, means making it possible to inject a fluid into the turbine and means making it possible to discharge this fluid from the turbine.

A casing which fixes the stationary body of the turbine to the pump body and forms an annular space round the assembly consisting of the sleeve and of the two connections; this annular space comprises two annular end zones each arranged respectively on the same side as one or other of the two ports of the pump and, between these two annular end zones, a central annular zone in which the rotor of the turbine is located; the said annular end zones form respectively the inlet chamber and outlet chamber of the turbine; ports made in the said casing make it possible to inject pressurized fluid into the inlet chamber and discharge this fluid out of the outlet chamber; the sleeve is guided in rotation by means of bearings which are fixed to the casing and which support it on its periphery.

Means making it possible to inject a pressurized fluid into the inlet chamber of the turbine are capable of maintaining, in the said central annular zone, a pressure higher than the pressure prevailing in the interior of the sleeve, the pressure difference between this central annular zone and the interior of the sleeve being such that, during the functioning of the motor-driven pump, a fluid film passes between the bearings and the sleeve, ensuring lubrication between these members and the lifting of the sleeve and preventing the liquid from passing from the interior of the sleeve towards the interior of the annular space.

Preferably, annular gaskets are arranged between the bearings and the sleeve and also between the sleeve and the connections, these gaskets being capable of ensuring a suitable flow of the pressurized fluid passing between these relatively moving members and of preventing pumped liquid and particles from passing from the interior of the sleeve towards the interior of the annular space, without impairing the rotation of the sleeve.

The fluid driving the turbine is preferably selected from the group comprising water, air, a mixture of water and air and a laden liquid extracted from the environment of the motor-driven pump.

According to a preferred embodiment, deflecting fins are mounted in the said annular space between the central annular zone and each of the two annular end zones.

The inlet chamber of the turbine is preferably located on the same side as the suction port of the pump and the outlet chamber is located on the same side as the delivery port of the pump. Thus, the pressurized fluid passing through the turbine exerts on the turbine blades (and therefore on the sleeve) a thrust, of which the axial component is in the opposite direction to the axial component of the thrust which the rotary members of the pump must exert on the liquid to be pumped.

According to a particular embodiment, the pump possesses helical vanes extending from the inner face of the sleeve and directed towards the axis of the latter.

In one embodiment, an empty space extends between the axis of the sleeve and the vanes; in this embodiment, the reduction in the surface of the vanes is compensated by an insensitivity to the large-size debris which can be carried along through the sleeve.

These vanes can also be connected along a line coinciding with the axis of the sleeve.

According to an advantageous embodiment, these rotary pumping members take the form of an Archimedean screw; this Archimedean screw can preferably be given a progressive pitch.

According to an alternative embodiment, the pumping members are connected to the outer surface of a tube portion open at both ends and arranged in the same axis as the sleeve; the end of this tube directed towards the inlet port of the pump is connected by means of a rotary joint to a stationary pipe which opens out on the outside of the pump body, at the same time passing through the wall of the connection forming the suction port of the motor-driven pump or the wall of a suction pipe, if appropriate joined to this connection. This stationary pipe can be connected to a device capable of generating a vacuum therein and thus sucking up some of the liquid near the axis of the pump. This stationary pipe can also be connected to a device capable of injecting therein a fluid intended for mixing with the pumped liquid.

This particular embodiment of the motor-driven pump affords several advantageous possibilities, especially when the motor-driven pump is used for dredging. In fact, when the said stationary pipe is connected to a suction pump, some of the liquid at the centre of the pump which is less rich in solids than the liquid passing via its periphery can be extracted and discharged to the outside. This liquid with a low solid content can, if appropriate, be expelled under pressure towards a location near the dredging head and thus stir up the seabed at this location and make dredging easier.

However, the said stationary pipe can also be connected to a pump which injects water into it, thus making it possible to dilute the pumped sludges, should the dredging conditions require such a mode of operation. Alternatively, air can be injected into the stationary pipe and, under the effect of the state of turbulence prevailing in the pump, divides into bubbles and thus generates a mammoth pump effect in the delivery line. This effect is advantageously combined with the characteristics of the pump in order to increase its efficiency.

According to another advantageous embodiment, the pumping members are connected along a tube portion arranged in the axis of the sleeve and closed at its end directed towards the operating port of the pump; the interior of this portion is put in communication with at least one duct of small diameter made in the thickness of each vane and, via staggered distribution ports, opening onto the surface of these vanes near the leading edge of the said vanes, in the regions where there is a high risk of cavitation, the flow of liquid passing through these ports being such that no vacuum (favourable to the occurrence of cavitation phenomena) is generated in the region where these distribution ports open out.

According to another embodiment, the rotary pump of the motor-driven pump is a Moineau pump, the outer part of which is fixed to the inner face of the sleeve and is arranged in the axis of the latter; one of the ends of the central part engaged in the outer part is supported by means of a joint with a shaft; the other end of this shaft is attached by means of another joint to a support fixed to the stationary pump body.

When the motor-driven pump is used as a submerged motor-driven pump for dredging, the fluid discharged from the turbine is advantageously conveyed towards vents arranged near the dredging head, so as to contribute to the disintegration and fluidization of the medium from which the pumped liquid is extracted.

According to a particular embodiment, the motive-fluid supply line is connected to a mixer equipped with vents capable of causing a certain proportion of ambient liquid to be driven along by the said motive fluid.

Another subject of the invention is a device for removing sediments from sea, river or lake beds, which is mounted on a dredging appliance and which comprises a boom, of which one end intended to be submerged is equipped with a head, and at least one motor-driven pump connected to the said boom; this device possesses at least one motor-driven pump which accords with what was described above and which is connected to the boom near its submerged end, the axis of rotation of these motor-driven pumps or this motor-driven pump coinciding with the axis of the boom, in such a way that the pumped sediments do not experience any axial change of direction as they rise towards the other end of the boom.

This device can, for example, be installed on a dredging boat, whether it has a trailing boom, is stationary or at a fixed point or with a disintegration means. It can also be used on a boat for the mining of nodules at great depth.

BRIEF DESCRIPTION OF THE DRAWING

Other particular features and advantages of the invention will emerge from the description of particular embodiments described below, here two motor-driven dredging pumps, given by way of non-limiting example, reference being made to the accompanying drawings in which.

DESCRIPTION OF PREFERRED EMBODIMENTS

Figure 1:
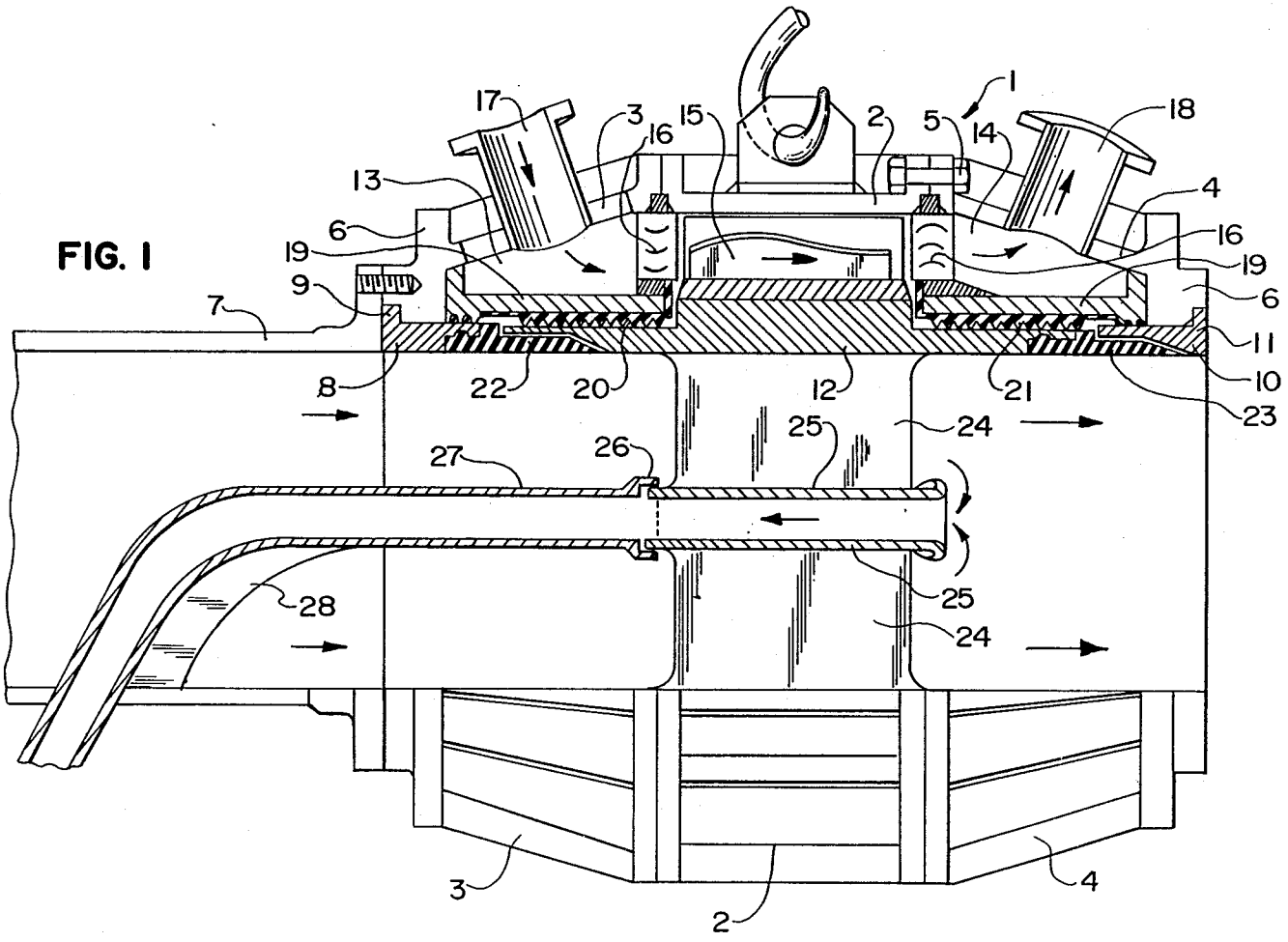
FIG. 1 is a partially sectional side view of a motor-driven pump according to the invention equipped with a vane pump.

The motor-driven pump 1 shown in FIG. 1 comprises a casing formed essentially from a cylindrical element 2 and from two conical elements 3 and 4. Both the elements 2 and 3 and the elements 2 and 4 are assembled together by means of bolts 5.

The conical elements 3 and 4, at their free end, carry flanges 6 making it possible to connect the motor-driven pump 1 to suction and discharge pipes 7.

An inlet connection 8 is mounted inside the said casing near one of its ends. A ring 9 integral with the connection 8 is gripped between the flange 6 and the suction pipe 7.

In a similar way, a discharge connection 10 having a ring 11 is mounted and fixed in place inside the casing near its other end. The connections 8 and 10 are aligned in the same axis and have the same diameter.

Mounted between the connections 8 and 10 is a rotary sleeve 12 aligned in the same axis as these connections 8, 10 and having the same inside diameter as these. This rotary sleeve 12 is an element which is common to the pump and to the turbine and which constitutes both the limit of and the transmission between these two essential parts of the motor-driven pump 1.

The said annular space has, on the same side as the conical element 3 and the inlet connection 8, an annular zone which is the inlet chamber 13 of the turbine.

Likewise, on the same side as the conical element 4 and the connection 10, an annular end zone forms the outlet chamber 14 of the turbine.

Mounted between the inlet chamber 13 and the outlet chamber 14 is the turbine, of which the rotor together with the blades 15 is fastened against the outer surface of the sleeve 12.

Deflecting fins 16 are mounted between the inlet chamber 13 and the turbine and also between the turbine and the outlet chamber 14, so as to achieve a higher performance of the turbine.

An inlet port 17 allows access to the inlet chamber 13 and makes it possible to inject a pressurized fluid into it. An outlet port 18 makes it possible to discharge this fluid from the outlet chamber 14.

Bearings 19 guide the sleeve 12 and absorb the axial forces exerted on this. Gaskets 20 and 21 fixed respectively to the bearings 19 are fitted between these and the sleeve 12.

A gasket 22 fixed to the inlet connection 8 ensures the transition between this connection 8 and the sleeve 12. Similarly, a gasket 23 fixed to the sleeve 12 ensures the transition between this sleeve 12 and the discharge connection 10.

The motor-driven pump 1 is designed more particularly as a submerged motor-driven pump for dredging. Lubrication at the gaskets 20, 21, 22 and 23 is obtained by means of a liquid available in the environment of the pump, that is to say, here, seawater. In fact, seawater is used as a motive fluid for the turbine, and this seawater is injected into the inlet chamber 13 at a pressure which is distinctly higher than the pressure prevailing in the interior of the sleeve 12.

Under the effect of the overpressure, a film of seawater, continually renewed, infiltrates into the spaces contained between the gaskets 20 and 21 and the sleeve 12, detaching the contact surfaces of these members from one another. The seawater passing under the gaskets 20 and 21 enters the inner space of the sleeve 12 and of the discharge connection 10, at the same time lubricating the gaskets 22 and 23. These gaskets 22 and 23 and the over-pressure maintained in the annular space surrounding the sleeve 12 prevent any return of liquid from the inner volume of the sleeve 12 towards the said annular space.

The motor-driven pump 1 is equipped with a rotary vane pump. Vanes 24 fixed to the inner face of the sleeve 12 extend in the direction of the axis of the sleeve 12 and are connected to the outer surface of a tube portion 25 open at both ends and arranged in the axis of the sleeve 12.

That end of the tube 25 directed towards the suction port of the pump is connected by means of a rotary joint 26 to a stationary pipe 27 which opens out on the outside of the pump body and which passes through the wall of the suction pipe 7. A rib 28 increases the rigidity of the stationary pipe 27 in the region where it is bent.

The stationary pipe 27 is connected, outside the motor-driven pump 1, to a suction pump (not shown). When the motor-driven pump 1 is in operation, for example as a submerged motor-driven dredging pump, the vanes 24 exert a centrifuging effect on the sucked-up mixture, the result of this being that the water passing near the axis of the pump is laden with solids to a distinctly lesser extent than the water passing over the periphery. By means of the suction pump connected to the stationary pipe 27, some of this less laden water is sucked into the tube 25 and returned outside the motor-driven pump 1, thereby increasing the solids content of the liquid conveyed towards the wells of the dredging boat.

Since the inlet and discharge connections 8 and 10 are aligned in the same axis, the pumped liquid does not experience any pressure loss attributable to a sudden change of direction, as occurs in the motor-driven pumps of known type.

The compact and rigid construction of the casing of the motor-driven pump 1 makes it possible for the latter to withstand high stresses under tension, torsion and bending. This factor is extremely advantageous when work has to be carried out between two bodies of water under unceasing stresses and often in opposite directions.

The advantage of the motor-driven pump 1 is that the energy of the motive fluid is transmitted directly to the pump without mechanical losses attributable to a coupling or to a speed reducer; furthermore, by means of the turbine, the risks associated with the use of electricity in an ocean environment or in wet places (inherent in electric-motor pumps) are eliminated.

Figure 2:
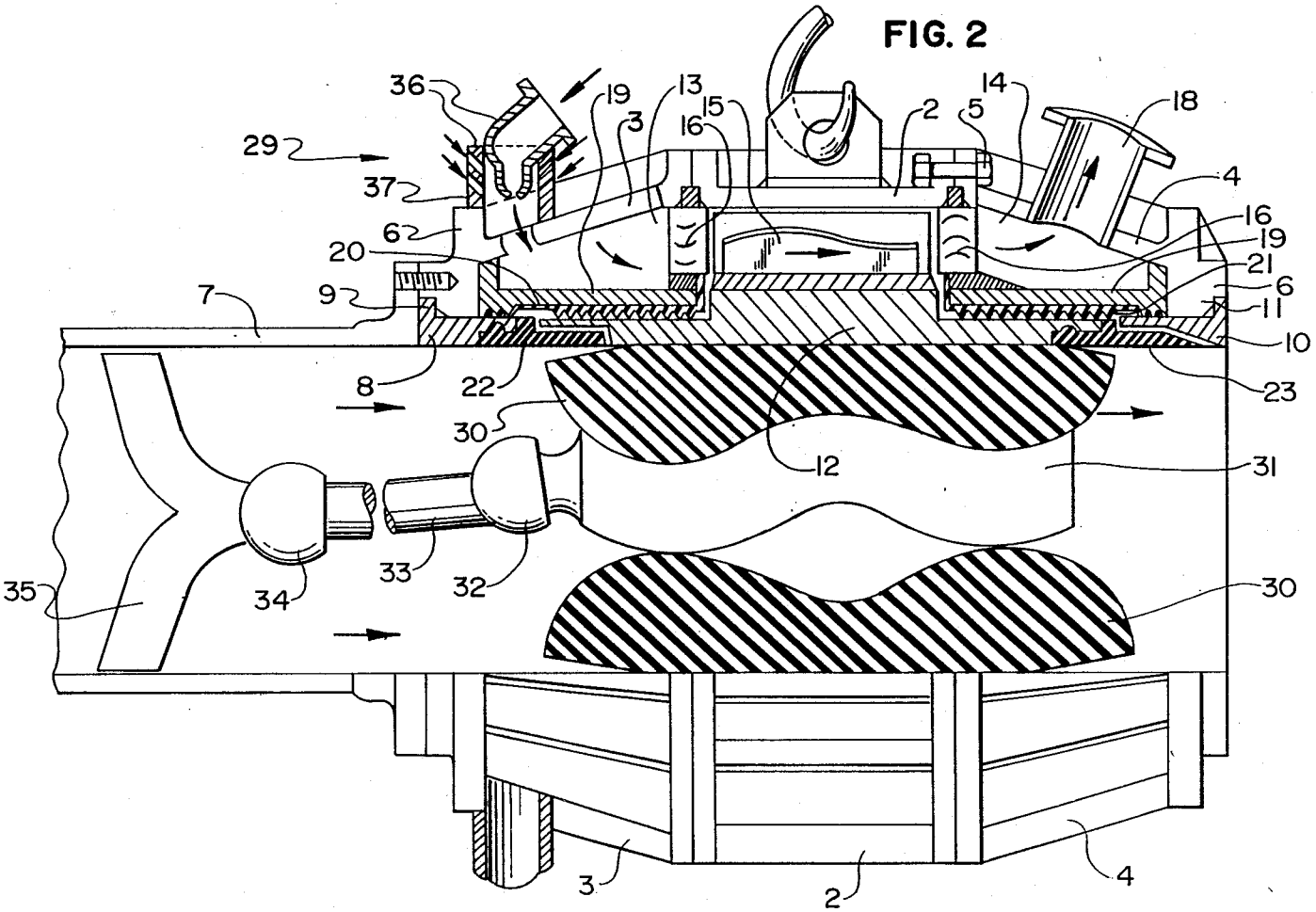
FIG. 2 is a partially sectional side view of a motor-driven pump according to the invention equipped with a Moineau pump.

FIG. 2 illustrates a motor-driven pump 29 similar to the motor-driven pump 1 shown in FIG. 1, but equipped with an "inverted" Moineau pump and not with a vane pump.

The outer part 30 of the Moineau pump is fastened inside the rotary sleeve 12.

The central part 31 of the Moineau pump is fastened, by means of a coupling 32, to the end of a shaft 33 which, at its other end, is connected by means of a coupling 34 to a stationary support 35 fixed to a suction pipe 7.

A motor-driven pump 29 equipped with a Moineau pump is especially useful for the constant-flow pumping at high pressure of viscous mixtures, such as sludgy or clayey mixtures.

The air/water mixture used by the turbine of the motor-driven pump 29 is produced by means of a mixer 36 equipped with an injector 37 located at the head of the injection port 17 of the inlet chamber 13.

Figure 3:
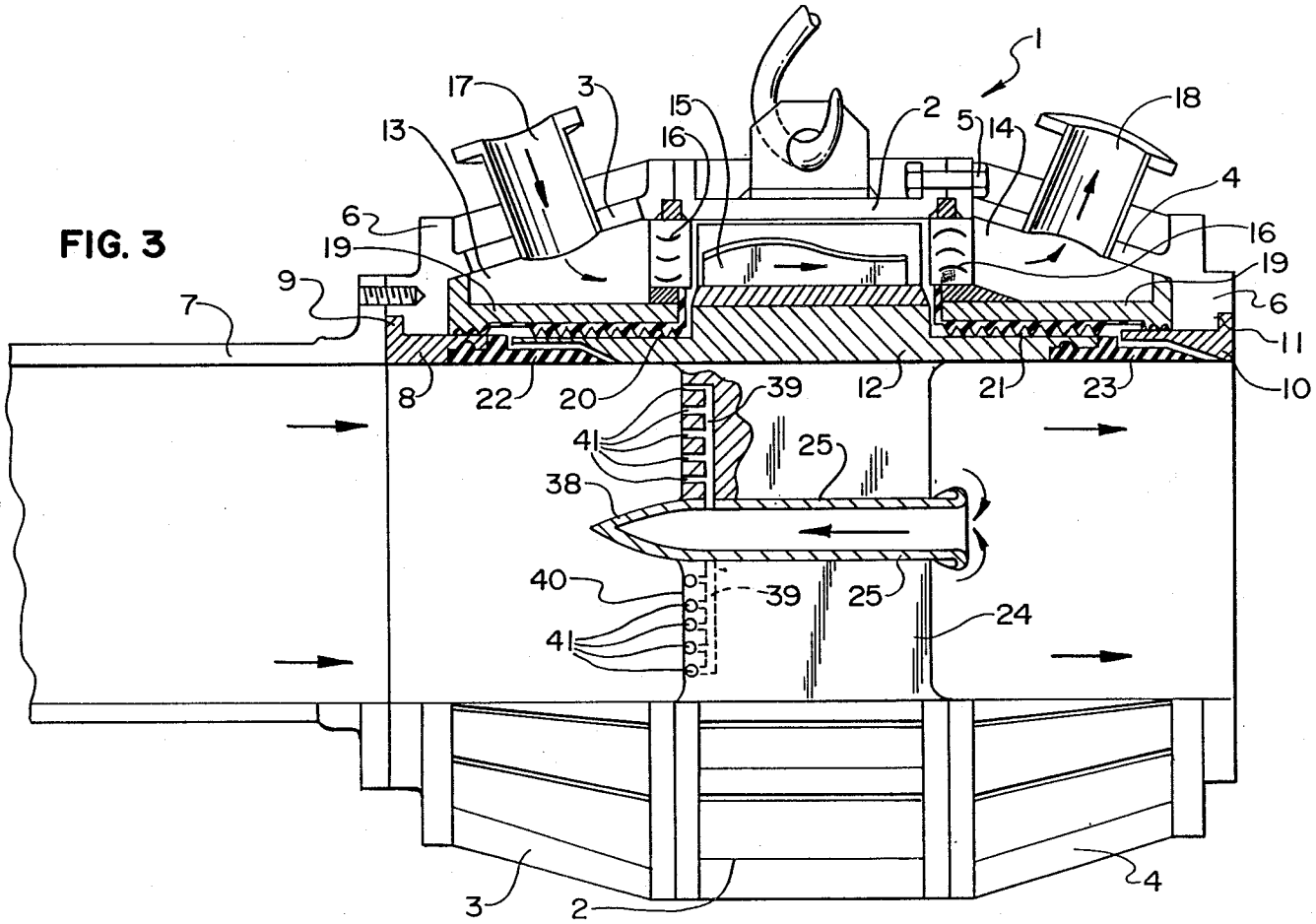
FIG. 3 is a partially sectional side view, with a localized cutaway, of a motor-driven pump equipped with a vane pump.

FIG. 3 is a sectional view of an embodiment of the turbo-pump which makes it possible to limit or prevent cavitation phenomena on the vanes.

The vanes 24 of the pump are connected to a tube portion 25 which extends in the axis of the sleeve 12. This tube portion 25 is open on the same side as the delivery port; the end 38 located on the operating side is closed and has a streamlined form, so as to offer low resistance to the passage of the pumped liquid. A duct of small diameter 39 is made in the thickness of each vane 24 near the leading edge 40. Small ports 41 put the surface of the vane 24 in communication with this duct of small diameter 39. When the pump 1 is in operation, a vacuum zone flavouring the occurrence of the cavitation phenomenon is obtained in the immediate vicinity of the leading edge 40 of the vanes 24.

This vacuum zone is cancelled as a result of the localized addition of pressurized liquid in the zone in question via the small distribution ports 41 and via the duct of small diameter 39.

The injection liquid is taken from the central zone on the delivery side and is therefore laden only slightly, the particles of higher density having experienced a centrifuging effect. Moreover, the liquid is at a pressure higher than that of its ejection zone. Finally, the network formed by the tube portion 25 and the ducts of small diameter 39 acts as a centrifugal pump, continuously injecting at the surface of each vane a sufficient quantity of liquid to prevent the cavitation phenomenon from occurring in this region.

Figure 4:
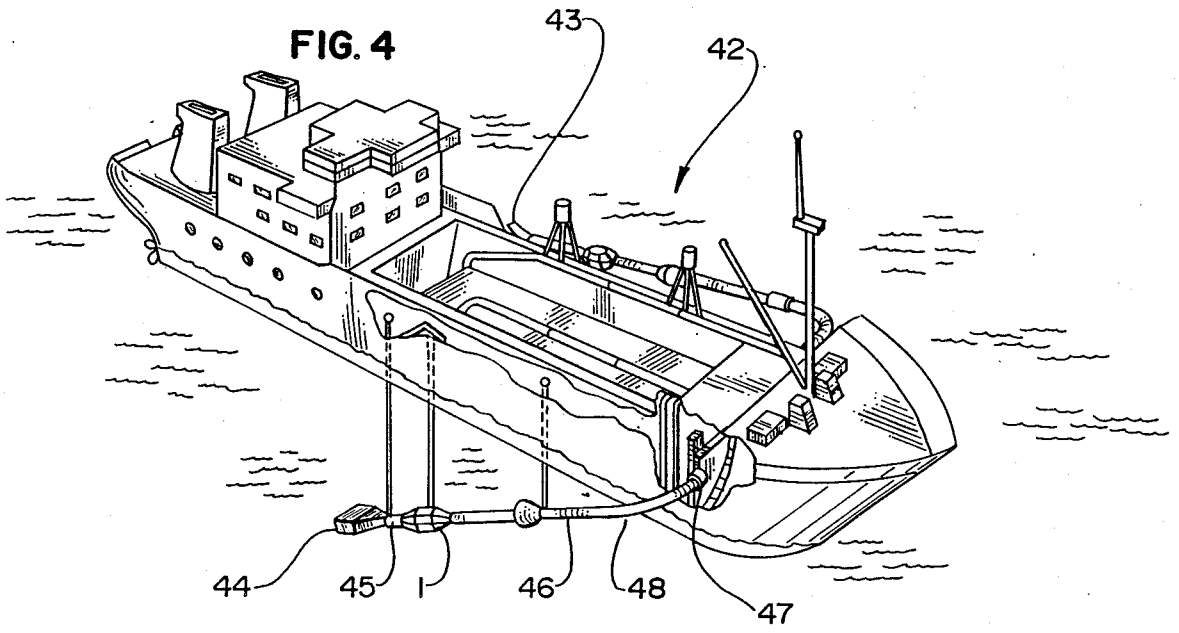
FIG. 4 is a diagrammatic view of a dredging device according to the invention.

FIG. 4 illustrates diagrammatically a type of dredging boat 42 equipped with in-line dredging devices 43 according to the invention.

One dredging device 43 is located on the port side in the raised position for transport.

A second device 43 is in position, lowered towards the bottom. Each device 43 possesses a strainer 44 which is drawn along on the bottom to be dredged. This strainer 44 is connected to a secondary boom 45. This secondary boom 45 is connected to the suction port of a motor-driven pump according to the invention. The latter is constantly "under pressure" and conveys the liquid sucked up via the main boom 46 towards the suction pump 47 located on board the dredging boat 42. Depending on the power of the pump according to the invention, this suction pump 47 can simply be omitted. If the depth or the density of the pumped liquid justifies it, a second pump 1 can perfectly well be placed in line behind the first. From strainer 44 to elbow 48 which is connected to the suction pump 47, the laden liquid experience virtually no change of direction; the pressure losses attributable to friction are therefore reduced to a minimum, most of the energy being used to cause the sludges to rise from the bottom to the dredging well. There is virtually no wear attributable to the localized concentrated impact of particles (as occurs when centrifugal pumps are used).

Although the motor-driven pump according to the invention has been described within the framework of its use for dredging, it can also be employed for other uses with different types of rotary pumps, whenever the aim is to reduce the bulk of a pump and of its drive system, or when the work is to be carried out under difficult conditions in terms of maintenance, for liquids laden with salts or mineral particles (coal, sand, diamondiferous muds, etc.), especially in mines, waste fluids transport, etc.

Since the boom 43, 46 and the pump (or pumps) are aligned in the same axis, the damage caused by larger debris is also limited.

However, an especially advantageous factor is that within a medium especially testing for the equipment, in this particular case the saline and corrosive ocean environment, the dredger pump precisely makes use of the surrounding liquid, moreover laden, in order to actuate and lubricate the movable components. This considerably simplifies its design and maintenance and an extended utilization coefficient is obtained.

This design is also advantageous as regards the protection of the environment; in fact, there is no addition of other liquids of different composition which can have a disruptive effect on the environment; on the other hand, the liquid used is not contaminated by the presence of lubricant residues, since these pollutant products are simply not used in the pump.

It is also found that the pump 1, since it is in the axis of the booms 45, 46, withstands much better the stresses generated as a result of the manoeuvres (embarkation, disembarkation) and during service (catching, immobilization of the strainer or bottom as a result of the suction effect, the effect of variation of level).

It is of very light-weight design because of its single casing and the absence of couplings and fragile components to be protected. It is therefore easy to use such a dredging device operating at very great depths, care being taken each time to pair two motor-driven pumps rotating in opposite directions, to prevent torsion effects (attributable to the torque of the turbines) on the boom 46. The possibility of working with lifting appliances of relatively low carrying capacity is also an important economic factor. This possibility for the motor-driven pump to work even at very great depth, without the worry of maintenance or sealing problems, allows it to be used successfully for special work at sea, such as the mining of nodules. In this case, the boom is kept vertical and has a sufficient number of concentric pumps 1 to ensure that nodules extracted from the seabed are conveyed to the surface. Here too, care is taken to rotate the pumps two by two in opposite directions, so as to avoid subjecting the boom to excessive torsional force during starting or during a change of speed of the turbines.

The technical idle time of such a pump is also greatly reduced; its design is extremely robust by definition, and components subject to wear can easily be replaced without dismantling the pump completely.

What is claimed is:

1. Turbine-driven rotary pump driven by a pressurized fluid intended for the pumping of liquids and of liquids laden with solid particles, which comprises:

a stationary pump body possessing a connection forming a cylindrical suction port and a connection forming a cylindrical delivery port, these two connections of the same inside diameter being arranged in line with one another, a cylindrical sleeve of inside diameter substantially equal to that of these two connections and mounted in line between these connections, with a small clearance relative to these, this sleeve being capable of rotating about its axis, and rotary pumping members being mounted inside this sleeve and being fixed to the latter, a drive turbine actuated by pressurized fluid and mounted in a ring round the sleeve, a rotor supporting the blades of the turbine being mounted outside the sleeve and being fixed to the latter, inlet means making it possible to inject a fluid into the turbine, and outlet means making it possible to discharge this fluid from the turbine, a casing which fixes the stationary body of the turbine to the stationary pump body and which forms an annular space round the assembly consisting of the sleeve and of the two connections, wherein the said annular space comprises two annular end zones each arranged respectively on the same side as one or other of the two ports of the pump and, between these two annular end zones, a central annular zone in which the rotor of the turbine is located, the said annular end zones forming respectively an inlet chamber and an outlet chamber of the turbine, ports made in the said casing making it possible to inject pressurized fluid into the inlet chamber and discharge this fluid out of the outlet chamber, the sleeve being guided in rotation by means of bearings fixed to the casing and supporting it on its periphery, the pressurized fluid drive means making it possible to inject a fluid into the inlet chamber of the turbine being capable of maintaining, in the central annular zone, a pressure higher than the pressure prevailing in the interior of the sleeve, the pressure difference between this central annular zone and the interior of the sleeve being such that, during the functioning of the motor-driven pump, a fluid film passes between bearings fixed to the casing and the sleeve, thus ensuring lubrication between these members and the lifting of the sleeve and preventing pumped liquid and particles from passing from the interior of the sleeve towards the annular zone.

2. Motor-driven pump according to claim 1, wherein annular gaskets are arranged between bearings and the sleeve and between the sleeve and the connections, these gaskets being capable respectively of ensuring a suitable flow of the pressurized fluid between these relatively moving members and of preventing pumped liquid and particles from passing from the interior of the sleeve towards the interior of the annular space, without impairing the rotation of the sleeve.

3. Motor-driven pump according to claim 1 wherein deflecting fins are mounted in the said annular space between the central annular zone and each of the two annular end zones.

4. Motor-driven pump according to claim 1 wherein the inlet chamber of the turbine is located on the same side as the suction port of the pump and the outlet chamber of the turbine is located on the same side as the delivery port of the pump.

5. Motor-driven pump according to claim 1 wherein the fluid driving the turbine is selected from the group comprising water, air, mixtures of water and air and a laden liquid extracted from the environment of the motor-driven pump.

6. Motor-driven pump according to claim 5 wherein the rotary pumping members comprise helical vanes extending from the inner face of the sleeve and directed towards the axis of the latter.

7. Motor-driven pump according to claim 6, characterized in that an empty space extends between the axis of the sleeve and the vanes.

8. Motor-driven pump according to claim 6, characterized in that the said vanes are connected along a line coinciding with the axis of the sleeve.

9. Motor-driven pump according to claim 6 wherein the pumping members are connected to the outer surface of a tube portion unsupported by bearings, open at both ends and arranged in the same axis as the sleeve, the end of this tube directed towards the suction port of the pump being connected by means of a rotary joint to a stationary pipe which opens out on the outside of the pump body.

10. Motor-driven pump according to claim 9, wherein the said stationary pipe is connected to a device capable of generating a vacuum therein, the said stationary pipe thus being capable of sucking up some of the pumped liquid less laden with particles near the axis of the pump.

11. Motor-driven pump according to claim 9, wherein the said stationary pipe is connected to a device capable of injecting, via the said stationary pipe, near the axis of the sleeve all or some of the fluid discharged from the turbine.

12. Motor-driven pump according to claim 6 wherein the pumping members are connected to a tube portion arranged in the axis of the sleeve and closed at its end directed towards the suction port of the pump, the interior of this tube portion being put in communication with at least one duct of small diameter extending radially in the thickness of each vane and opening out at the back of the leading edge of these vanes via distribution ports, the flow of liquid passing through these distribution ports when the motor-driven pump is in operation being such that no vacuum is generated in the region where these distribution ports open out.

13. Motor-driven pump according to claim 5, characterized in that the rotary pumping members comprise an Archimedean screw.

14. Motor-driven pump according to claim 13, characterized in that this Archimedean screw has a progressive pitch.

15. Motor-driven pump according to claim 13, wherein the pumping members are connected to the outer surface of a tube portion unsupported by bearings, open at both ends and arranged in the same axis as the sleeve, the end of this tube directed towards the suction port of the pump being connected by means of a rotary joint to a stationary pipe which opens out on the outside of the pump body.

16. Motor-driven pump according to claim 15; characterized in that the said stationary pipe is connected to a device capable of generating a vacuum therein, the said stationary pipe thus being capable of sucking up some of the pumped liquid less laden with particles near the axis of the pump.

17. Motor-driven pump according to claim 15, characterized in that the said stationary pipe is connected to a device capable of injecting, via the said stationary pipe, near the axis of the sleeve all or some of the fluid discharged from the turbine.

18. Motor-driven pump according to claim 5 wherein the rotary pump is a Moineau pump, the outer part of which is fixed to the inner face of the sleeve and is arranged in the axis of the latter, one of the ends of the central part engaged in the outer part being fastened by means of a coupling to a shaft, the other end of this shaft being attached, likewise by means of a coupling, to a support fixed to the stationary pump body.

19. Device for removing sediments deposited on sea, river or lake beds, which is mounted on an appliance comprising a boom, of which one end intended to be submerged is equipped with a strainer, and at least one motor-operated pump connected to the said boom and capable of driving the said sediments through the boom, characterized in that it possesses at least one motor-driven pump according to claim 18, connected to the boom near its submerged end, its axis of rotation coinciding with the axis of the boom, in such a way that the pumped materials do not experience any axial change of direction as they rise towards the other end of the boom.

20. Device for removing sediments deposited on sea, river or lake beds, which is mounted on an appliance comprising a boom, of which one end intended to be submerged is equipped with a strainer, and at least one motor-operated pump connected to the said boom and capable of driving the said sediments through the boom, characterized in that it possesses at least one motor-driven pump according to claim 5, connected to the boom near its submerged end, its axis of rotation coinciding with the axis of the boom, in such a way that the pumped materials do not experience any axial change of direction as they rise towards the other end of the boom.

* * * * *